US005569059A

United States Patent [19]

Kirt

[11] Patent Number: 5,569,059

[45] Date of Patent: Oct. 29, 1996

[54] SYSTEM FOR DRIVING A CENTERLESS GRINDER REGULATING WHEEL

[75] Inventor: Thomas J. Kirt, Clinton Township, Mich.

[73] Assignee: Grinders Clearing House, Warren, Mich.

[21] Appl. No.: 159,298

[22] Filed: Dec. 23, 1993

[51] Int. Cl.[6] ..... B24B 49/00

[52] U.S. Cl. ..... 451/5; 451/243; 451/332

[58] Field of Search ..... 451/5, 242, 243, 451/244, 245, 332, 338; 474/101, 112

[56] References Cited

U.S. PATENT DOCUMENTS

| | | | |
|---|---|---|---|
| 2,979,869 | 4/1961 | Birleson et al. | 451/245 |
| 3,064,487 | 11/1962 | Warrick et al. | 474/112 |
| 3,209,498 | 10/1965 | Dall | 451/245 |
| 3,416,384 | 12/1968 | Maca | 474/112 |
| 4,270,906 | 6/1981 | Kraft et al. | 474/101 |
| 4,541,502 | 9/1985 | Iwai et al. | 474/112 |
| 4,783,932 | 11/1988 | Sager | 451/245 |
| 4,887,992 | 12/1989 | Dixon | 474/101 |
| 4,889,436 | 12/1989 | Lynn, Jr. | 474/112 |
| 4,923,434 | 5/1990 | Nemirosky | 474/101 |

*Primary Examiner*—Maurina T. Rachuba
*Attorney, Agent, or Firm*—Brooks & Kushman P.C.

[57] ABSTRACT

An electric servomotor drive system for controlling the regulating wheel of a centerless grinder is disclosed. The electric servomotor replaces the transmission normally used on centerless grinders and provides infinitely variable speed control of the regulating wheel. The system is designed for retrofitting centerless grinders manufactured by a variety of machine tool builders.

17 Claims, 3 Drawing Sheets

SYSTEM FOR DRIVING A CENTERLESS GRINDER REGULATING WHEEL

TECHNICAL FIELD

The present invention relates to a centerless grinding machine. More particularly, it relates to a centerless grinding machine in which the regulating wheel is controlled by an electric servomotor.

BACKGROUND ART

Centerless grinders are widely used in the machine tool industry in the manufacture of cylindrical industrial products, such as fuel injector pins, gears, shafts, and the like. Such grinders are typically utilized to provide a smooth finish or precise dimensions to such cylindrical parts. The workpiece being ground is rotated in a direction counter to that of the grinding wheel while being ground to achieve a uniform finish without excessive heat generation.

Centerless grinders generally contain certain key elements to accomplish such function. These grinders typically have a grinding wheel and a regulating wheel adjacent to and facing each other in a predefined grinding area. The regulating wheel serves to rotate the part being finished or ground, and the grinding wheel performs the grinding and finishing operation. The regulating wheel contacts the workpiece and rotates it in a direction opposite to that of the grinding wheel, usually at a much slower speed. For example, the grinding wheel may rotate at 3000 r.p.m. whereas the regulating wheel may only rotate at 100 r.p.m. in the opposite direction, depending, of course, on the particular application.

The centerless grinders also generally include a dresser for the grinding wheel and a dresser for the regulating wheel along with their associated control components. The dressers serve to reshape the abrasive surface of the wheels since the surfaces may wear unevenly during the grinding operation. Such uneven wear may result in an undesirable finish or imprecise dimensioning of the workpiece.

In some applications, a single grinding machine may actually perform more than one grinding operation thus requiring more than one grinding speed. For example, a centerless grinder may perform a "rough" grinding cycle, which removes a comparatively large amount of stock from the part, at a particular combination of grinding/regulating wheel speed. The same grinder would then change the relationship between the grinding wheel/regulating wheel speed (by changing either or both wheel speeds) before performing a "finish" grinding operation. A finish operation is typically performed at a higher grinding/regulating wheel speed ratio, which removes less stock than the roughing operation thereby achieving a more uniform surface finish.

Large, constant speed motors are typically used to drive the grinding and regulating wheels. A transmission is provided to couple each wheel to its respective motor while also controlling the speed of the wheel relative to the motor. Such transmissions are complex members containing a plurality of gears, shafts, chains, and sprockets. They are typically equipped with a clutch and operator lever to manually shift the transmission thereby changing the gear ratio so as to achieve a different output speed.

Prior art centerless grinders rely on the use of such transmissions as driving means, such as the grinder disclosed in U.S. Pat. No. 4,783,932. This grinder includes a transmission as its driving means such that the drive mechanism is coupled to the regulating wheel so that the drive mechanism and the drive coupling means move jointly with the regulating wheel.

The use of such complex transmission systems on centerless grinders often results in the necessity for frequent repairs. It is not uncommon for the transmission to be rebuilt or replaced several times during the useful life of the centerless grinder. Such repairs are expensive and time-consuming resulting in a reduction in the efficiency of the manufacturing operation since the grinder is unoperational.

SUMMARY OF THE INVENTION

It is thus an object of the present invention to provide an improved control for centerless grinding machines which eliminates the transmissions of the prior art.

It is another object of the present invention to provide increased availability of regulating wheel speeds while improving the control of the regulating wheel speed.

It is another object of the present invention to reduce the downtime associated with repair or replacement of grinding wheel driving means by replacing a traditional transmission with an electric servomotor drive system.

It is another object of the present invention to provide a system for driving and controlling a centerless grinder regulating wheel which easily adapts to existing centerless grinders.

In accordance with the present invention, an electric servomotor is used to drive the regulating wheel of a centerless grinder thereby eliminating the need for a traditional transmission to couple the regulating wheel to a main drive motor. Two potentiometers serve as inputs to an infinitely adjustable servomotor control allowing two modes of operation. One potentiometer is used to set the regulating wheel speed during a dressing cycle while the other potentiometer sets the regulating wheel speed during a grinding cycle.

The above objects and other objects, features, and advantages of the present invention will be readily appreciated by one of ordinary skill in the art from the following detailed description of the best mode for carrying out the invention when taken in connection with the accompanying drawings.

BEST MODE FOR CARRYING OUT THE INVENTION

Figure 1:
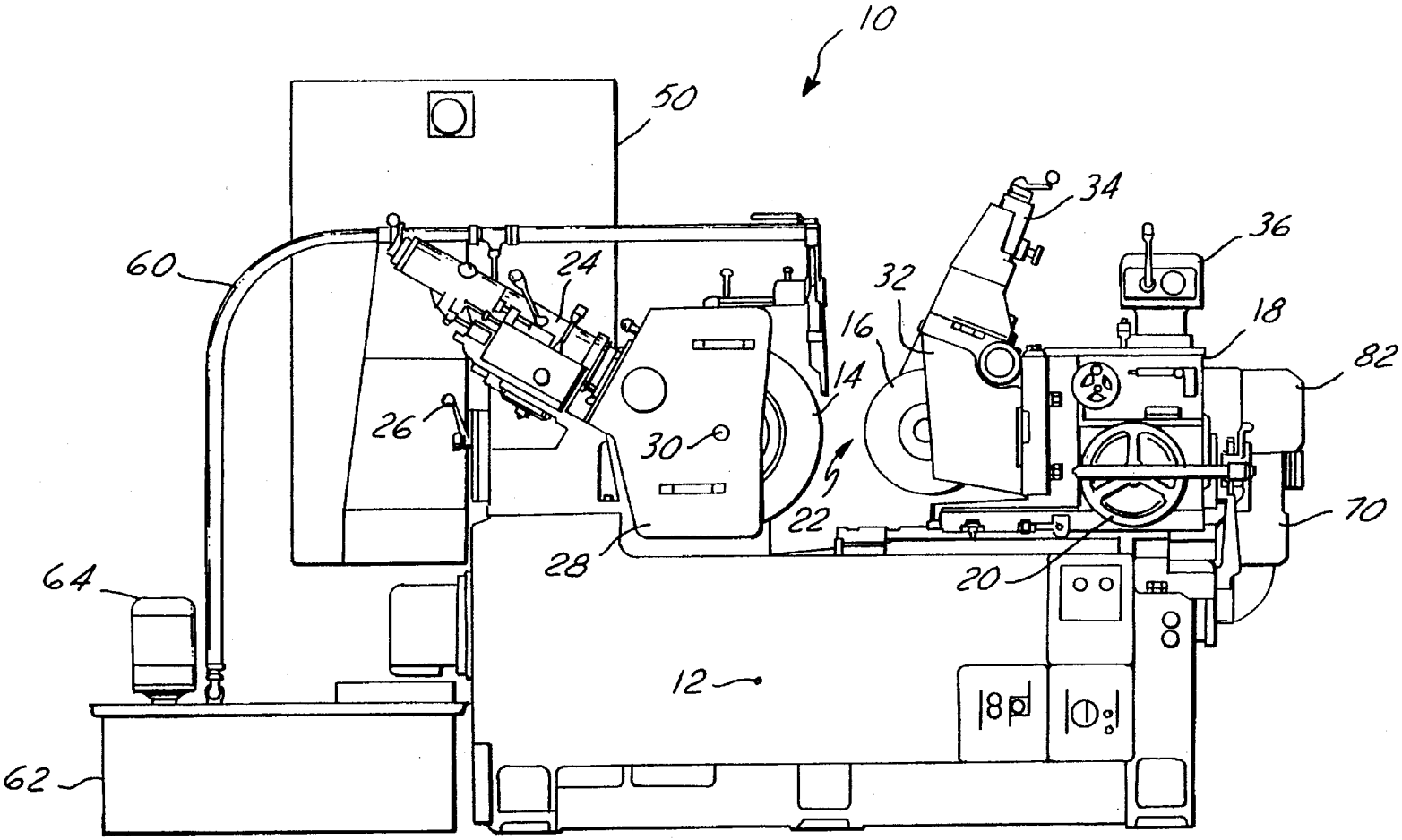
(PRIOR ART) FIG. 1
FIG. 1 is a front elevation of a prior art centerless grinder.
Figure 2:
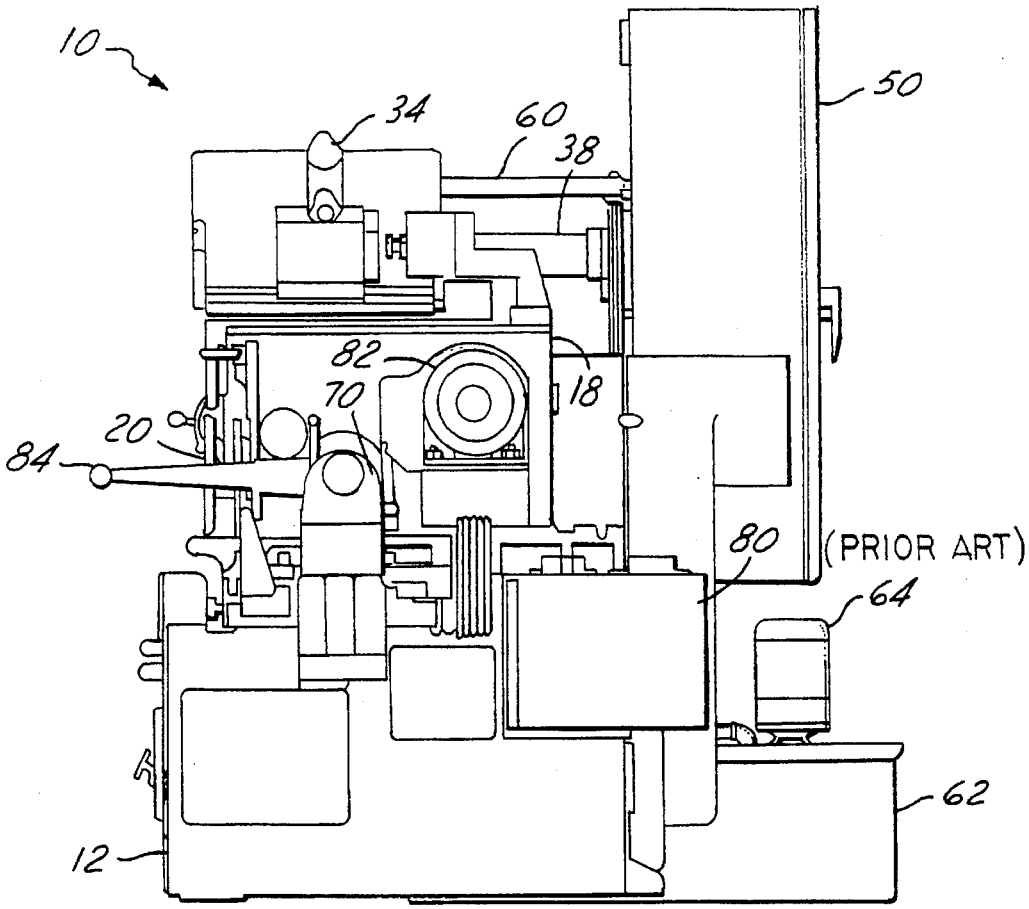
FIG. 2 is a side elevation of the prior art centerless grinder of FIG. 1.

FIGS. 1 and 2 illustrate a typical prior art centerless grinding machine. In this instance, the machine illustrated is a Model 220-8 centerless grinder manufactured by Cincinnati Milacron of Cincinnati, Ohio.

Referring now to FIG. 1, the centerless grinder is referred to generally by reference numeral 10. The grinder 10 includes a base 12, a grinding wheel 14, a regulating wheel 16, a transmission drive box 18 (which houses a traditional transmission, not specifically shown), and an infeed mechanism 20. A work area 22 is provided between the grinding wheel 14 and the regulating wheel 16 for positioning the workpiece during the grinding operation.

A dresser mechanism 24 is used to "dress" the face of the grinding wheel, as is well known in the art. Control 26 operates the grinding wheel dresser. The grinding wheel is positioned on spindle 30 which is operated and controlled by the centerless grinder to maintain a particular grinding speed. Protective cover 28 is used to enclose the grinding wheel and shield the operator from water and coolant sprayed on the wheel.

Regulating wheel 16 also has an associated protective cover 32 and a dresser mechanism 34 which is used to dress the regulating wheel. Control 36 is used to operate the regulating wheel dresser mechanism. The dresser mechanism for the regulating wheel system is translationally moveable by hydraulic cylinder 38, best illustrated in FIG. 2. Electrical panel 50 provides the power source and appropriate control logic incorporating motor starters, control relays, selector switches, push buttons, and the like, as is well known in the art.

Still referring to FIG. 1, feed line or hose 60 supplies water or other coolant to work area 22 from coolant tank 62. The water or coolant functions to maintain the temperature of workpieces within an acceptable range during the grinding operation. This is necessary to accurately control the dimensions of the workpiece which would otherwise vary due to thermal expansion/contraction. Coolant pump 64 is operative to supply coolant to work area 22 via feed line 60.

The infeed device 20 includes a yoke 70. The infeed device is used to move the workpiece and regulating wheel 16 into close proximity with grinding wheel 14 in preparation for grinding. The device normally contains means for coarse movement in positioning the workpiece in addition to means for a more gradual, controlled infeed during the actual grinding of the workpiece.

With the exception of the spindle drive motors, hydraulic pressure is used as the primary means for controlling the various portions of the centerless grinder to advance the regulating wheel 16, grinding wheel 14, and the workpiece during the grinding operation. A hydraulic pump (not specifically illustrated for the sake of clarity) and its associated controls are positioned within hydraulic box 80, best illustrated in FIG. 2, of grinder 10.

The speed of regulating wheel 16 is controlled by the transmission within transmission drive box 18. The transmission includes a drive motor 82 and a shift lever 84, as shown in FIG. 2. The shift lever 84 is used to change the gear ratio of the transmission thereby modifying the relationship between the output and input speeds. The internal mechanisms of a centerless grinder transmission may be any of a number of those which are well known in the art, a specific example of which is not shown for the sake of brevity. To summarize, however, a number of various gears, bushings, and shafts are contained in a drive box unit. Typically, a pair of drive shafts are positioned in the drive box unit, each associated with either the high or the low speed gearing mechanism. A speed adjusting shaft is positioned transverse to the drive shaft in order to regulate the speed of the unit. A clutch mechanism is used to allow shifting of the transmission between the high and low gears.

Figure 3:
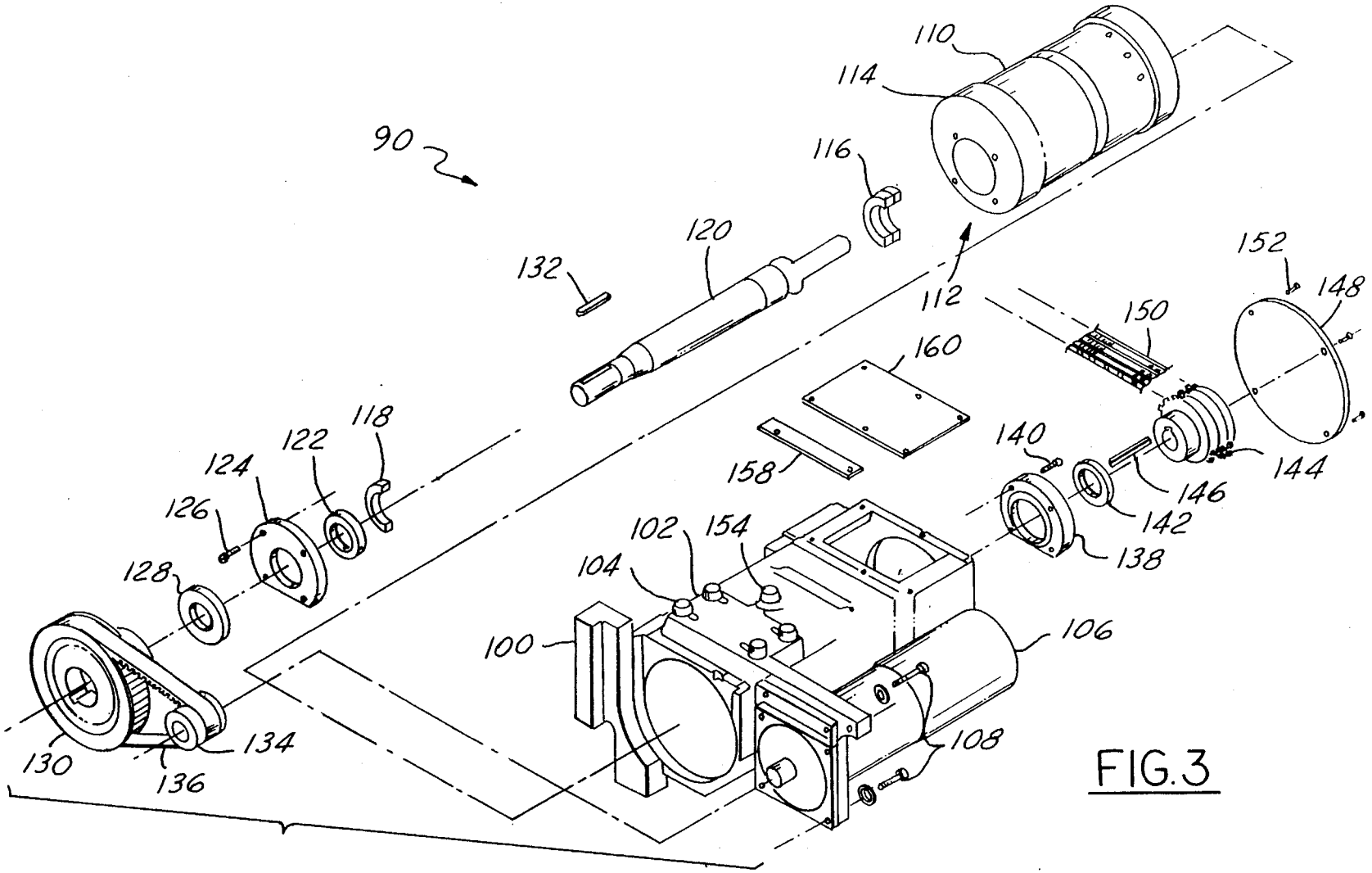
FIG. 3 is an exploded perspective view illustrating an electric servomotor and its associated coupling components according to the present invention.

The present invention eliminates a typical regulating wheel transmission thus obviating the associated repairs, rebuilding, and/or replacement commonly associated with such transmissions. The various shafts, spindles and gears of the transmission are replaced by an electric servomotor system utilizing significantly fewer parts as illustrated in FIG. 3. As previously indicated, the electric servomotor system of the present invention is designed to be retrofitted on any of a number of commercially available centerless grinding machines. Therefore, the system fits entirely within a typical transmission drive box, such as transmission drive box 18. Thus, with all safety covers and shields in place, it is difficult to discern the difference between a prior art centerless grinder and a centerless grinder incorporating the electric servomotor system of the present invention to drive the regulating wheel. This is an inherent characteristic of the present invention since it is adaptable to a number of prior art centerless grinding machines.

Referring now to FIG. 3, the electric servomotor system 90 includes a housing 100 for providing structural support to the various components of the system. A motor mounting bracket 102 is securely fastened to housing 100 via mounting bolts 104 and extends substantially perpendicularly from housing 100 to mount electric servomotor 106. Preferably, motor mounting bracket 102 has elongated slots to allow translational motion of servomotor 106 perpendicular to housing 100 for drive chain tightening as explained below. Electric servomotor 106 may be any of a number of commercially available variable speed servomotors, which include the Dynaserv Direct Line Brushless Servomotor Series DR-B available from Parker Hannifin Corporation of Rohnert Park, Calif. Another suitable servomotor is a "305 Series" brushless motor manufactured by Moog, Inc. of East Aurora, N.Y. Such servomotors have integral thrust bearings and tachogenerators thus eliminating the need for separate thrust bearings and pulse generators commonly found in the prior art.

Mounting bolts 104 may extend through housing 100 to fasten another motor mounting bracket 102 to housing 100, thus further increasing the rigidity of the system. Electric servomotor 106 is then securely fastened to the motor mounting brackets via attachment bolts 108.

Cam unit 110 is inserted into housing 100 and is designed to be rotatable within housing 100 during an adjustment procedure, as further explained below. Cam unit 110 includes an axial aperture 112 which is offset a distance from the center axis, preferably ½ inch, so that a 180 degree rotation of cam unit 110 within housing 100 will translate the center of aperture 112, relative to the center axis of servomotor 106, a total of twice the offset distance. This allows for replacement and subsequent tightening of rear drive belt or chain 150. Cam unit 110 includes a groove for receiving "O"-ring 114 for sealing the cam unit within housing 100.

Still referring to FIG. 3, cam unit 110 is adapted to receive rear bearing 116 and front bearing 118. Rear bearing 116 is larger in diameter than front bearing 118 to facilitate assembly. The bearings are installed to be concentric with aperture 112 and support jackshaft 120 within housing 100. Spacer 122 is selected during assembly, after installation of front bearing 118, from spacers having varying thicknesses to reduce translation movement of jackshaft 120 within housing 100. Front retainer 124 is fastened to cam unit 110 via bolts 126 before installing front seal 128. Driven timing wheel 130 is secured to jackshaft 120 by wedging keystock 132 into an appropriately sized groove in jackshaft 120, this method of attachment being well known in the art. Of course, a sprocket and chain arrangement could be utilized to couple electric servomotor 106 to jackshaft 120, however, a timing belt is preferred to prevent slipping and reduce noise associated with a chain and sprocket system. Drive timing wheel 134 is connected to electric servomotor 106 by any of a number of methods known in the art, such as described for driven timing wheel 130 utilizing a grooved shaft and sprocket with keystock. Timing belt 136 is installed and tensioned after assembly as detailed below.

As also shown in FIG. 3, rear retainer 138 is fastened to housing 100 via bolts 140 before installing rear seal 142. Triple sprocket 144 is secured to jackshaft 120 utilizing keystock 146 as previously described. Rear cover 148 is secured to housing 100 after rear drive chain 150 has been installed around triple sprocket 144, via fasteners 152. Rear drive chain 150 is coupled to a spindle which drives regulating wheel 16. After the electric servomotor drive system, indicated generally by reference numeral 90, has been installed on centerless grinder 10, an adjustment procedure is performed to properly tension timing belt 136 and triple drive chain 150.

The adjustment procedure begins with tensioning rear drive chain 150 by rotating cam unit 110 within housing 100. When properly tensioned, locator pin 154 is inserted through a hole in the top of housing 100 to engage one of a plurality of tensioning holes 156. Preferably, tensioning holes 156 are equally spaced around the perimeter of cam unit 110 at approximately 20° intervals. Timing belt 136 is then tensioned by moving motor mounting brackets 102 (and thus electric servomotor 106) away from housing 100 before tightening mounting bolts 104. Finally, access panels 158, 160 are fastened to top of housing 100.

Figure 4:
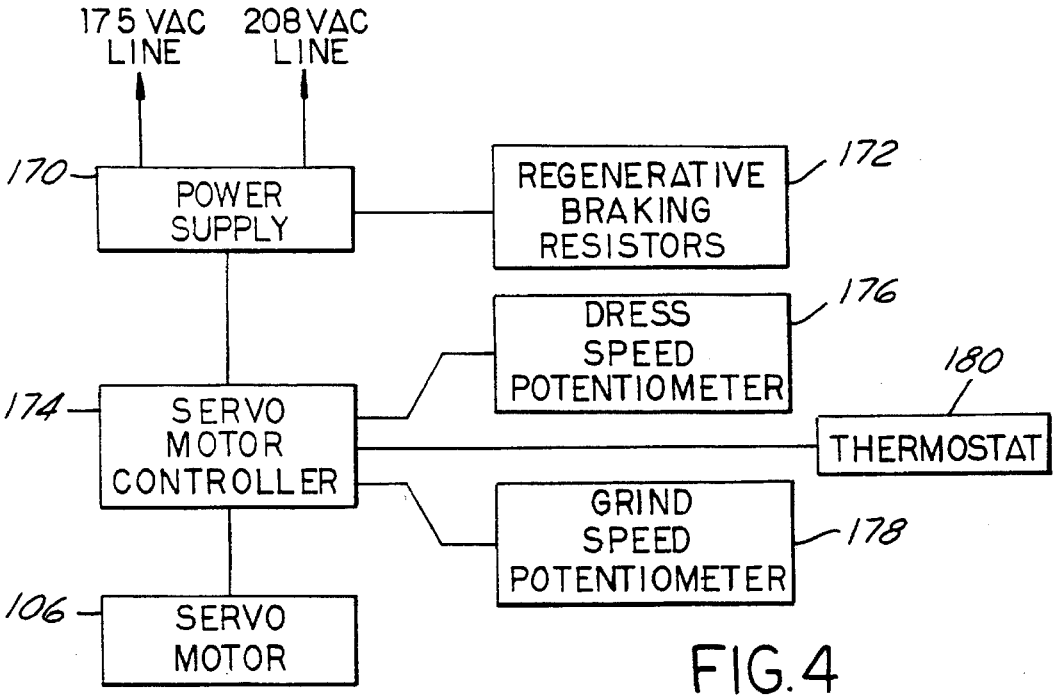
FIG. 4 is a schematic block diagram of the electrical connections for the electric servomotor and control potentiometers according to the present invention.

FIG. 4 is a schematic block diagram of the electrical connections for the electric servomotor system of the present invention. All the components shown are commercially available products common to the machine tool industry, as is well known in the art. Therefore, only a brief description and functional summary is given below.

Power supply 170 provides "clean" electrical power to the system by filtering out electrical noise and voltage and/or current spikes. In the preferred embodiment of the present invention, a step-down transformer with primary and secondary windings is utilized to provide source isolation and to step-down the voltage from 440 VAC to 208 VAC on the primary windings and 17.5 VAC on the secondary windings. The transformer may be part of power supply 170 or may be provided separately. Also, if large drive motors are used, it is desirable to attach a capacitor bank near the motors to balance the capacitive and inductive load thereby improving the power factor of the system, as is also well known in the art. Of course a different power supply arrangement could be used depending upon the demands of the particular application.

Still referring to FIG. 4, regenerative braking resistors 172 are used to provide rapid deceleration of the motor without the maintenance typically associated with mechanical brakes. Servomotor controller 174 provides a closed-loop feedback control system for servomotor 106. Controller 174 is normally a dedicated control for the particular brand of servomotor and is commercially available from the servomotor manufacturers identified above. Inputs to servomotor controller 174 include a dress speed potentiometer 176, a grind speed potentiometer 178, and a thermostat 180. Dress speed potentiometer 176 is used to set the speed of regulating wheel 16 during a dressing cycle whereas grind speed potentiometer 178 is used to control the speed of regulating wheel 16 during a grinding cycle. Thermostat 180 monitors the temperature of servomotor 106 and disables servomotor controller 174 if the temperature exceeds a safe operating level.

Servomotor controller 174 sends control signals to, and receives feedback signals from, electric servomotor 106 in addition to transmitting power to servomotor 106. The feedback signals include a pulse waveform indicating direction of rotation and rotational speed which is produced by the integral tachogenerator or encoder of servomotor 106.

It is understood, of course, that while the form of the invention herein shown and described constitutes the preferred embodiment of the invention, it is not intended to illustrate all possible forms thereof. It will also be understood that the words used are descriptive rather than limiting, and that various changes may be made without departing from the spirit and scope of the invention disclosed.

What is claimed is:

1. An apparatus for driving a regulating wheel rotatable about a spindle of a centerless grinder comprising:

a housing;

a shaft disposed within the housing having first and second ends which extend beyond the housing;

an electric servomotor mounted to the housing and coupled to the first end of the shaft, the servomotor being operative to rotate the shaft; and means for coupling the second end of the shaft to the spindle so as to drive the regulating wheel.

2. The apparatus of claim 1 further comprising a cylindrical cam unit having a longitudinal aperture, the aperture having a longitudinal axis parallel to, but displaced from, the cam unit longitudinal axis, the cam unit being selectively rotatable and disposed within the housing such that rotation of the cam unit varies the distance between the longitudinal axis of the aperture and a point on the housing perimeter.

3. The apparatus of claim 1 further comprising means for coupling the electric servomotor to the first end of the shaft.

4. The apparatus of claim 1 wherein the housing is adapted to be mounted within a drive box unit of a centerless grinder thereby replacing a regulating wheel transmission.

5. An apparatus for driving a regulating wheel rotatable about a spindle of a centerless grinder comprising:

a housing;

a cylindrical cam unit having a longitudinal aperture, the aperture having a longitudinal axis parallel to, but displaced from, the cam unit longitudinal axis, the cam unit being selectively rotatable and disposed within the housing such that rotation of the cam unit varies the distance between the longitudinal axis of the aperture and a point on the housing perimeter;

a shaft disposed within the aperture having first and second ends which extend beyond the cam unit;

an electric servomotor having a longitudinal axis, the servomotor mounted to the housing such that the longitudinal axis is parallel to the longitudinal axis of the cam unit and is displaced therefrom an adjustable distance, the servomotor being operative to rotate the shaft;

means for coupling the electric servomotor to the first end of the shaft; and means for coupling the second end of the shaft to the regulating wheel spindle so as to drive the regulating wheel.

6. The apparatus of claim 5 wherein the aperture of the cam unit is adapted to receive a plurality of bearings.

7. The apparatus of claim 5 wherein the cam unit includes a plurality of circumferentially disposed radial holes substantially equally spaced for securing the cam unit in a selected angular orientation within the housing thereby allowing adjustment of the means for coupling the second end of the shaft to the regulating wheel spindle.

8. The apparatus of claim 5 wherein the electric servomotor includes an output shaft and wherein the means for coupling the electric servomotor comprises:

a drive member mounted to the output shaft of the servomotor;

a driven member mounted to the first end of the shaft; and means for engaging the drive member and the driven member extending therebetween.

9. The apparatus of claim 5 wherein the means for coupling the second end of the shaft comprises:

a triple drive member mounted to the second end of the shaft; and means for engaging the triple drive member and extending between the triple drive member and the regulating wheel spindle.

10. The apparatus of claim 5 wherein the housing is adapted to be mounted within a drive box unit of a centerless grinder thereby replacing a regulating wheel transmission.

11. The apparatus of claim 5 further comprising an electric servomotor controller having a plurality of potentiometers, each corresponding to one of a plurality of regulating wheel operating modes, the potentiometers being operative to set the rotational speed of the regulating wheel, the servomotor controller being in electrical communication with the electric servomotor.

12. A centerless grinder having a regulating wheel and a grinding wheel rotatable about corresponding spindles, the regulating wheel being operative to rotate a workpiece in contact with the grinding wheel during a grinding cycle, the centerless grinder comprising:

a housing;

a cylindrical cam unit having a longitudinal aperture, the aperture having a longitudinal axis parallel to, but displaced from, the cam unit longitudinal axis, the cam unit being selectively rotatable and disposed within the housing such that rotation of the cam unit varies the distance between the longitudinal axis of the aperture and a point on the housing perimeter;

a shaft disposed within the aperture having first and second ends which extend beyond the cam unit;

an electric servomotor having a longitudinal axis, the servomotor mounted to the housing such that the longitudinal axis is parallel to the longitudinal axis of the cam unit and is displaced therefrom an adjustable distance, the servomotor being operative to rotate the shaft;

means for coupling the electric servomotor to the first end of the shaft; and means for coupling the second end of the shaft to the regulating wheel spindle so as to drive the regulating wheel.

13. The centerless grinder of claim 12 wherein the aperture of the cam unit is adapted to receive a plurality of bearings.

14. The centerless grinder of claim 12 wherein the cam unit includes a plurality of circumferentially disposed radial holes substantially equally spaced for securing the cam unit in a selected angular orientation within the housing thereby allowing adjustment of the means for coupling the second end of the shaft to the regulating wheel spindle.

15. The centerless grinder of claim 12 wherein the electric servomotor includes an output shaft and wherein the means for coupling the electric servomotor comprises:

a drive member mounted to the output shaft of the servomotor;

a driven member mounted to the first end of the shaft; and means for connecting the drive member and the driven member extending therebetween.

16. The centerless grinder of claim 12 wherein the means for coupling the second end of the shaft comprises:

a triple drive member mounted to the second end of the shaft; and means for connecting the triple drive member and the regulating wheel spindle extending therebetween.

17. The centerless grinder of claim 12 further comprising a drive box unit wherein the housing is adapted to be mounted within the drive box unit thereby replacing a regulating wheel transmission.

* * * * *